US006427641B1

(12) United States Patent
Ziegs

(10) Patent No.: US 6,427,641 B1
(45) Date of Patent: Aug. 6, 2002

(54) ENGINE DRIVEN HAND-OPERATED TOOL

(75) Inventor: Carsten Ziegs, Hamburg (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 09/636,820

(22) Filed: Aug. 10, 2000

(30) Foreign Application Priority Data

Aug. 12, 1999 (DE) ..... 299 14 164 U

(51) Int. Cl.[7] ..... F01P 1/00
(52) U.S. Cl. ..... 123/41.56
(58) Field of Search ..... 123/41.56

(56) References Cited

U.S. PATENT DOCUMENTS

| | | | | |
|---|---|---|---|---|
| 2,843,164 A | * | 7/1958 | Marsh | 126/204 |
| 3,855,976 A | * | 12/1974 | Notaras et al. | 123/41.56 |
| 4,261,302 A | * | 4/1981 | Sheldon | 123/41.56 |
| 4,932,366 A | | 6/1990 | Zerrer | 123/41.58 |
| 5,269,265 A | * | 12/1993 | Pretzsch et al. | 123/41.56 |
| 5,419,287 A | | 5/1995 | Evans | 123/41.29 |
| 5,522,355 A | * | 6/1996 | Uhl | 123/198 E |

FOREIGN PATENT DOCUMENTS

| | | |
|---|---|---|
| DE | 7020398 | 8/1970 |
| DE | 7322585 | 9/1973 |
| DE | 41 20 877 | 12/1992 |
| DE | 42 03 885 | 8/1993 |
| DE | 43 19 503 | 1/1994 |
| DE | 4033 261 | 6/1995 |
| DE | 296 06 668 | 8/1996 |
| DE | 38 11 788 | 10/1998 |
| JP | 082000064 | 8/1996 |

* cited by examiner

*Primary Examiner*—Noah P. Kamen
*Assistant Examiner*—Jason Benton
(74) *Attorney, Agent, or Firm*—McCormick, Paulding & Huber LLP

(57) ABSTRACT

In an engine driven hand-operated tool such as a chain saw, hedge trimmer, drill hammer and the like, cooling fluid for the engine downstream of the engine, so as to have been heated by the engine, is moved through a hollow handle of the tool to heat the handle.

16 Claims, 6 Drawing Sheets

ENGINE DRIVEN HAND-OPERATED TOOL

FIELD OF THE INVENTION

This invention relates to an engine driven hand-operated tool, especially a motor or a chain saw, with at least one handle which is configured hollow, and with a driving engine, especially an internal combustion engine or an electric motor and a fluid cooling with a cooling fluid flow being provided for driving engine.

BACKGROUND OF THE INVENTION

When working longer with an engine driven hand-operated tool which transfers high vibrations to a handle, it can come in dependence on these vibrations to circulatory disturbances in the hands of the operator who holds the hand-operated tool with the handle. This illness is also known as ischemic fingers illness. Such circumstances appear especially when using motor or chain saws, whereby low temperatures still reinforce this effect. Therefore, chain saws with an electric handle heating have already been constructed and marketed. However, because of the very low number of items produced, these chain saws are relatively expensive, have high production costs and high development costs, and all machines of a construction kit of the same type, even those without handle heating, must be provided with the necessary construction sparings for the components of the electrical heating, such as generator, cabling and switches, which means for the user without handle separation unnecessary construction width and weight, as well as disadvantages when handling.

The aim of this invention is to make available an improved hand-operated tool of the above mentioned type which eliminates the above mentioned disadvantages and thus prevents, at low temperatures, the risk of permanent impairments due to circulatory disturbances in the hands of an operator.

SUMMARY OF THE INVENTION

To this purpose, it is provided for according to the invention that the handle shows at least one inlet opening and at least one outlet opening, whereby the inlet opening and the outlet opening are placed in such a way that the cooling fluid flow downstream of the driving engine flows into the handle over the inlet opening, flows through the handle over a predetermined section and flows out of the handle again by the outlet opening.

This has the advantage that a handle heating is realized at low cost and without additional construction space required, whereby additional devices such as, for example, a generator, a cabling or a switch are not necessary. Each engine driven hand-operated tool can also be equipped later with this handle heating according to the invention simply and at low cost.

In a preferred embodiment, the fluid cooling is an air cooling and the cooling fluid flow a cooling air flow.

A simple and low cost assembly is obtained by the fact that an air conducting device fixed on the handle adjacent to the inlet opening is placed and configured in the cooling air flow downstream of the driving engine in such a way that the cooling air flow is at least partially intercepted by the air conducting device and is guided into the inlet opening on the handle. This air conducting device is configured, for example, as an air conducting sheet and is fixed or pushed-on or snapped-on onto the handle.

In an alternative preferred embodiment, the fluid cooling is a water cooling and the cooling fluid flow a cooling water flow.

A simple power regulation of the handle heating or of a temperature on the handle is obtained by the fact that a first slide is provided for the alternative opening, partial opening or closing selectively the inlet opening and/or a second slide for the opening, partialy partiality opening or closing the oulet opening.

In an appropriate manner, the handle is a stirrup-shaped handle or an allround handle and is configured, for example, as a metal tube or is made of plastic.

In a preferred embodiment, a device for guiding the cooling air flow downstream of the driving engine to the inlet opening is configured integrated into a tank/handle system.

The invention will be explained in more detail below with reference to the attached drawings.

BRIEF DESCRIPTION OF THE INVENTION

DETAILED DESCRIPTION OF THE PREFERRED EMBODIMENT

Figure 1:
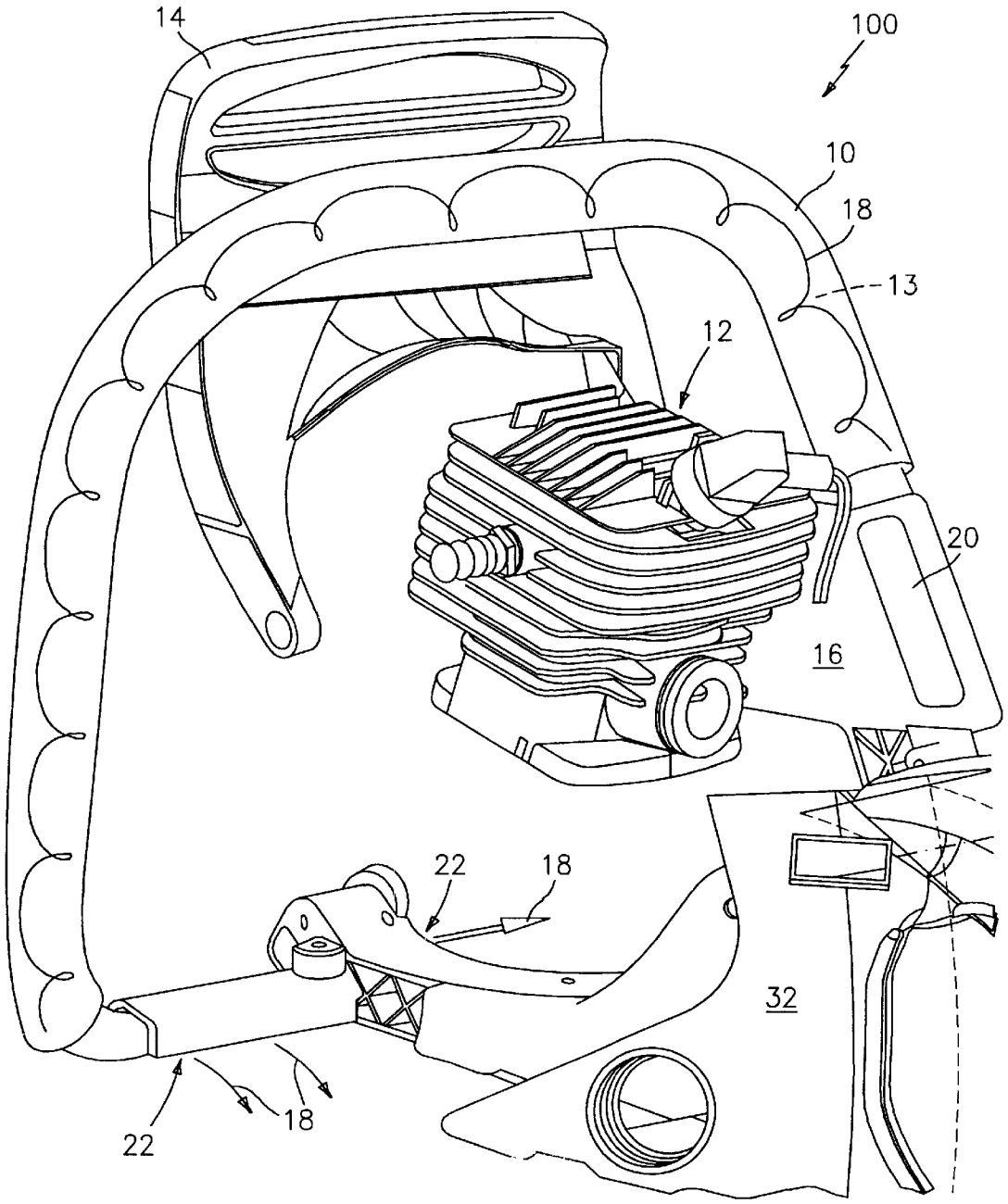
FIG. 1 is a schematic perspective representation of a first preferred embodiment for which air conducting and admission are integrated into the tank.
Figure 2:
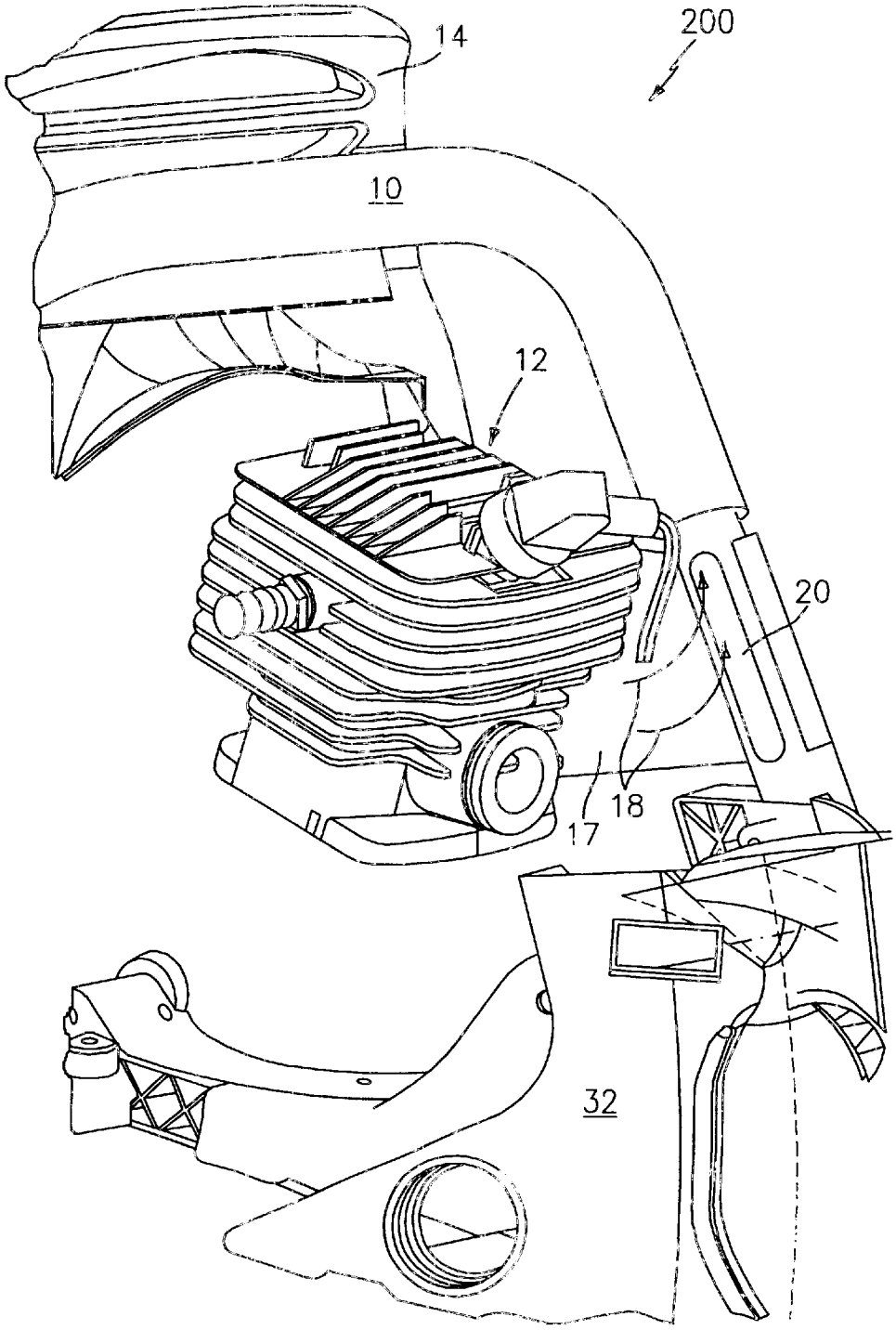
FIG. 2 is a schematic perspective representation of a second preferred embodiment for which air conducting and admission are integrated into the allround handle.
Figure 3:
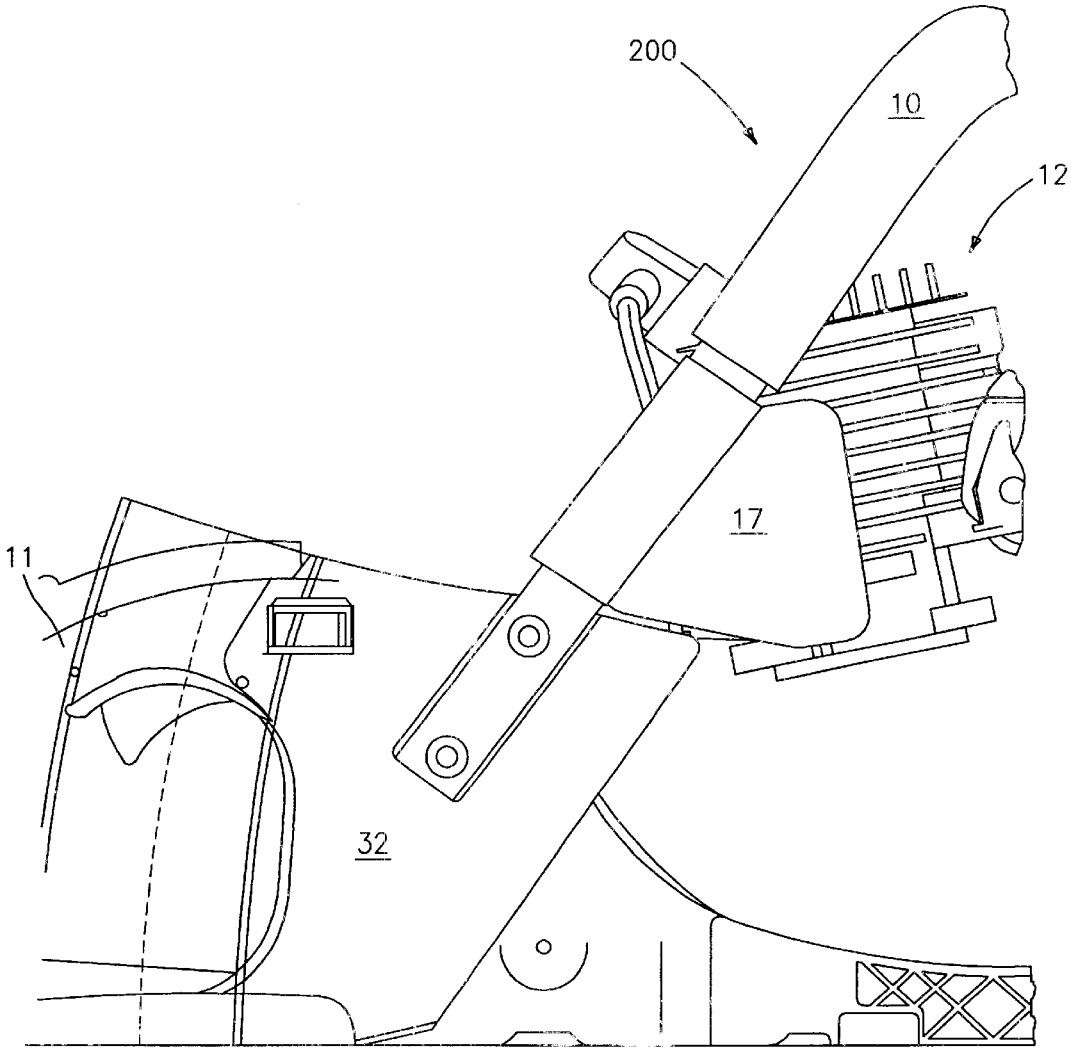
FIG. 3 is a schematic perspective representation of the version of FIG. 2 seen from the opposite side.

The invention will be explained below by means of the hand-operated tool in form of a chain saw with internal combustion engine represented in FIGS. 1 to 7, whereby this is to be understood only as an example. The invention can be used for every engine driven hand-operated tool with handle such as, for example, hedge shears, drill hammer etc.

The chain saw 100, 200, 300, 400 represented in different embodiments according to FIGS. 1 to 7 comprises a stirrup-shaped handle 10, a rear handle 11, an internal combustion engine 12 and a hand-guard 14 (FIGS. 1 to 4).

For the embodiments 100, 200, 300 represented in FIGS. 1 to 5, an air conducting device 16/17 is provided for which conducts a cooling air flow 18 downstream of the internal combustion engine 12, i.e. an air flow 18 which has already absorbed and dissipated heat from the internal combustion engine 12, to an inlet opening 20. This cooling air flow 18 heated by the waste heat of the internal combustion engine 12 now heats, for its part, the stirrup-shaped handle 10 by flowing through the hollow stirrup-shaped handle which constitutes an air channel 13 so that a hand of an operator who helds the hand-operated tool with the stirrup-shaped handle is heated correspondingly.

This cooling air flow 18 escapes at an outlet opening 22 again out of the stirrup-shaped handle 10 so that continuously newly heated air 18 can flow over the air conducting device 16. For the embodiment 100, 300 represented in FIGS. 1, 4 and 5, the air conducting device 16 or the air inlet is integrated into the stirrup-shaped handle 10 into a fuel/handle system 32, whereas in the embodiment 200 according to FIGS. 2 and 3 the air conducting device 16 is configured as a separate air conducting sheet which is pushed onto the stirrup-shaped handle 10 or injected on the stirrup-shaped handle.

Figure 4:
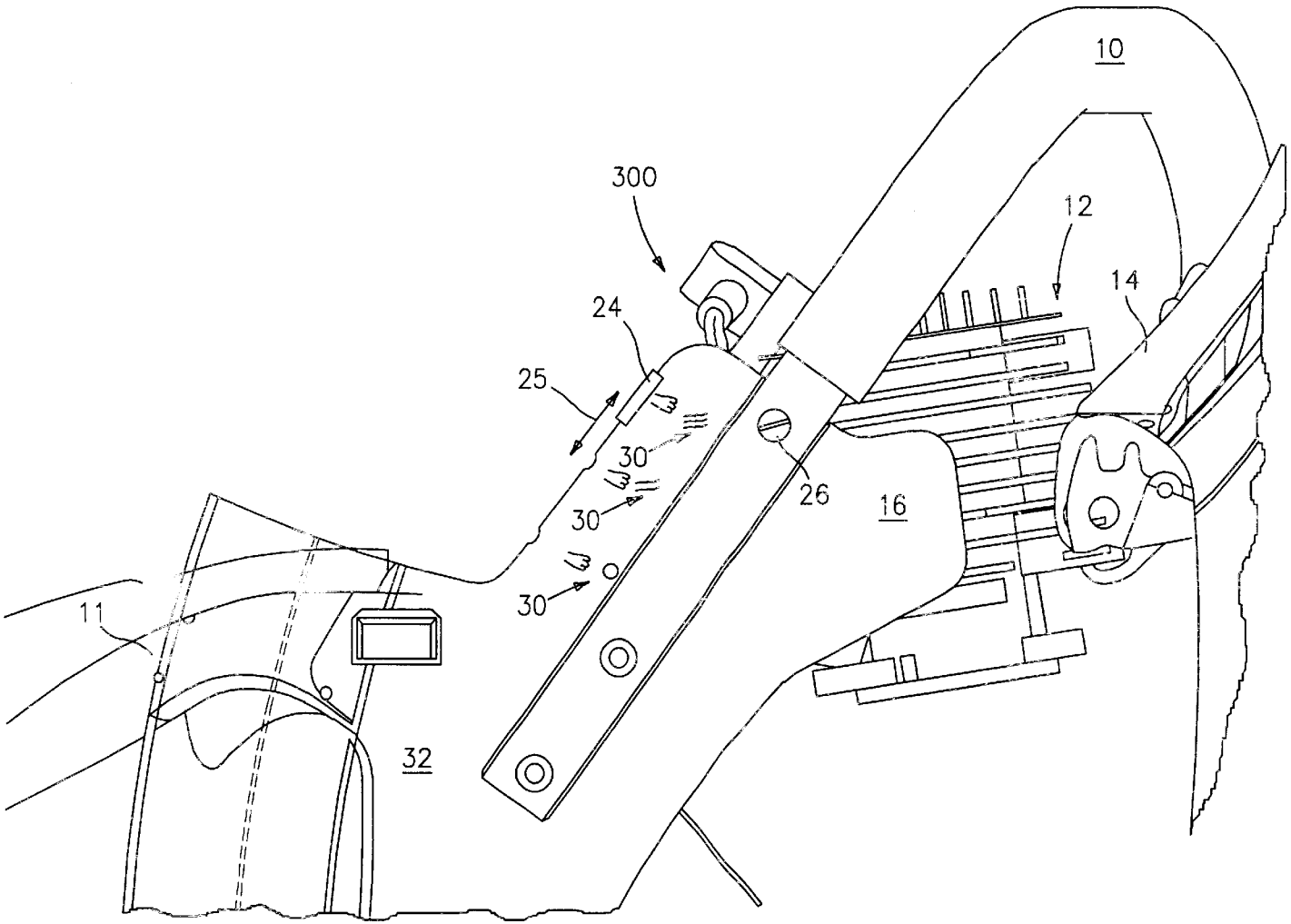
FIG. 4 is a schematic perspective representation of the version of FIG. 1 seen from the opposite side with integrated adjusting element.
Figure 5:
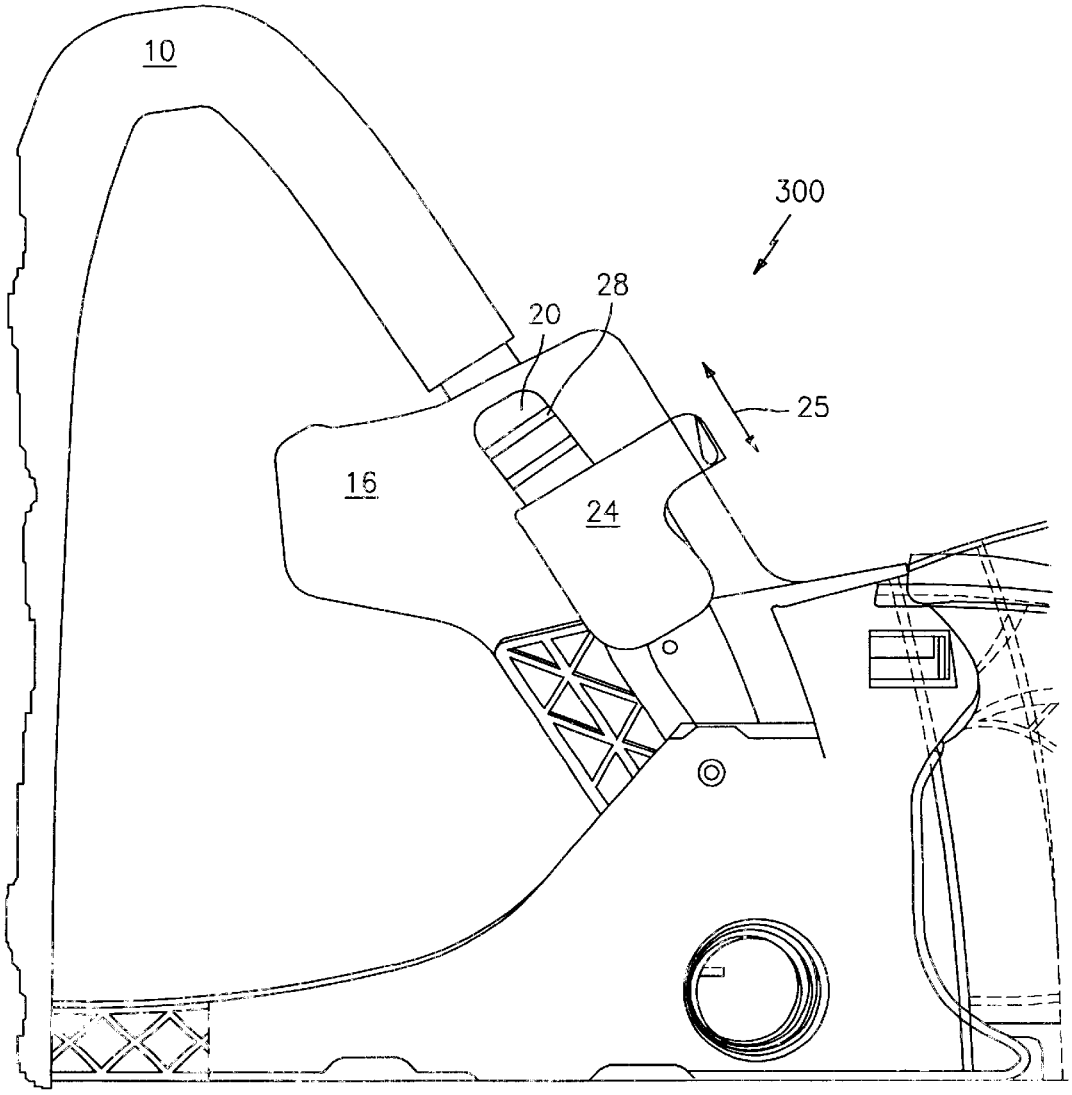
FIG. 5 is a further schematic perspective representation of the version of FIG. 4.

For the third preferred embodiment 300 represented in FIGS. 4 and 5, an adjusting element 24 is additionally provided which optionally closes, partially opens or totally opens the inlet opening 20, which can be seen in FIG. 5, on the stirrup-shaped handle 10 by moving in direction of the arrow 25. With this adjusting element 24, the temperature or the thermal output on the stirrup-shaped handle 10 can be adjusted by selecting its position correspondingly. For the position shown in FIG. 4, the adjusting element 24 is in the position "completely open", a maximal heating capacity being available on the stirrup-shaped handle 10. As it furthermore results from FIG. 4, an additional screwed connection 26 is provided on the stirrup-shaped handle 10 which makes available an additional support and bearing of the stirrup-shaped handle 10. Corresponding ribs (FIG. 5) serve as chip protection in front of the inlet opening 20.

Due to the at least partial air deviation of the warm cooling air 18 coming from the engine 12 through the stirrup-shaped handle 10, the stirrup-shaped handle is heated so that the probability of the ischemic fingers illness is considerably reduced without additional components such as generator, electrical heat conductor, cabling etc. Here, the air conducting device 16 is provided on the coupling side on the stirrup-shaped handle as an air trap which deviates at least a part of the warmed cooling air 18 into the stirrup-shaped handle 10. The air 18 escapes for example on the magnet side below from the outlet opening 22 (FIG. 1). The handle heating according to the invention can be realized with a stirrup-shaped handle 10 as a metal tube as well as with a stirrup-shaped handle 10 made of plastic.

For a metal tube handle 10, the inlet opening 20 and the outlet opening 22 are built-in for example by radial mechanical subsequent retouching work. Alternatively, the openings 20, 22 are realized by add-on elements such as, for example, a cast metal part. Furthermore, it is possible to integrate also the inlet and outlet openings 20, 22 into the tank 32, the cooling air flow 18 being then introduced preferably axially into the metal tube handle 10.

For a plastic allround handle 10, the openings 20, 22 can be produced by subsequent work, by a subsequent displacement of inserts in the plastic tool or by a stirrup-shaped handle produced in grain melting technology.

Figure 6:
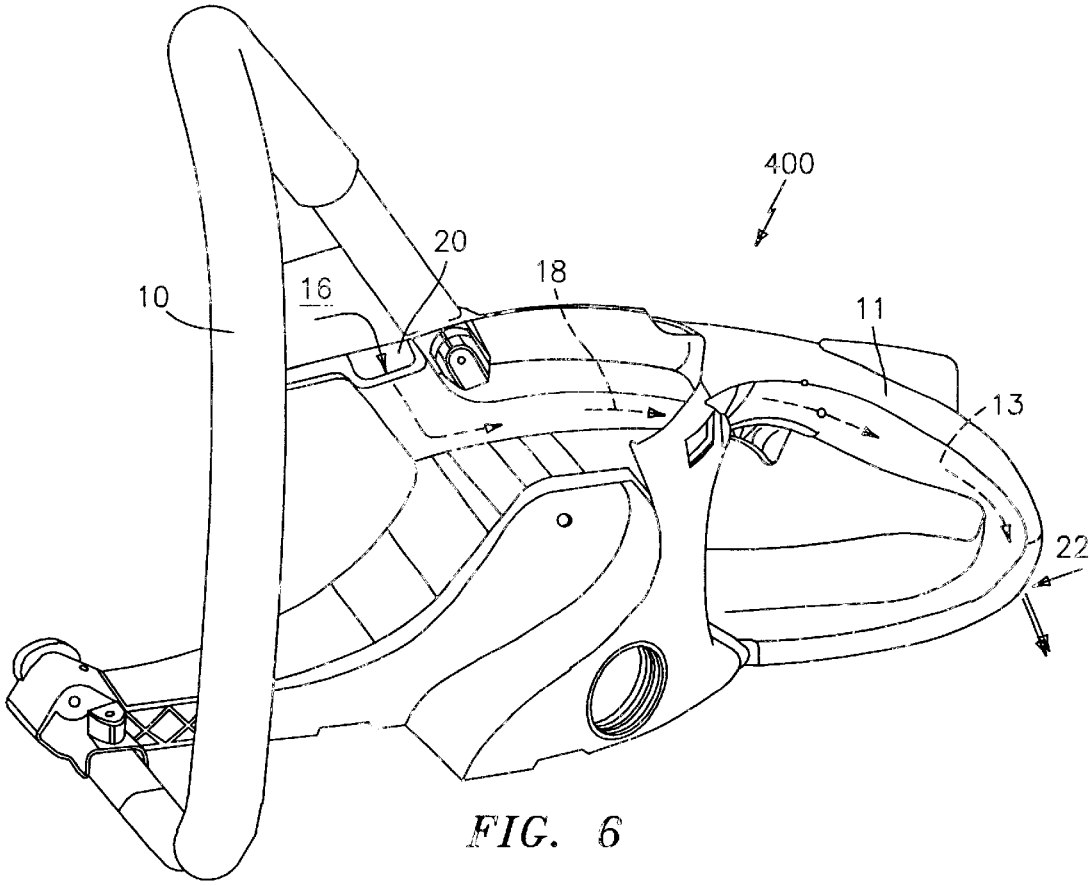
FIG. 6 shows in schematic perspective representations the heating of the rear handle.
Figure 7:
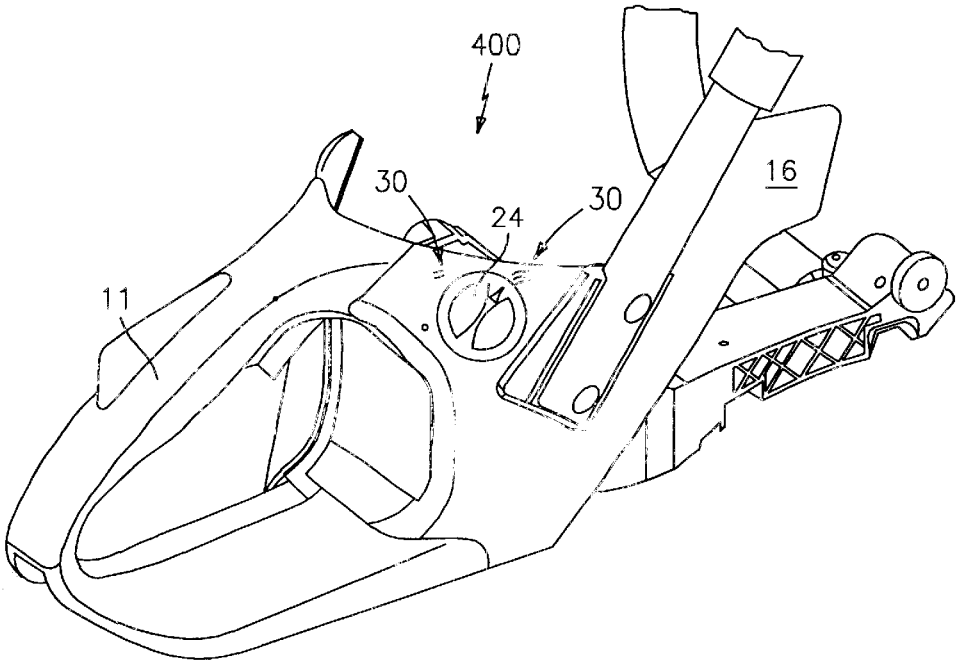
FIG. 7 is a schematic perspective representation of the version of FIG. 6 with an integrated actuator, represented from the opposite side.

For the embodiment represented in FIGS. 6 and 7, there takes place a heating of the rear handle 11 of the chain saw 400. The air flow 18 heated by waste heat flows into the inlet opening 20, is guided through the air channel 13 through the rear handle 11 into the outlet opening 22. The air channel 13 is integrated into the fuel tank/handle system 32. In FIG. 7, the rotatable adjusting element 24 for adjusting the heating capacity is represented; it snaps in into the different selection positions for the heating capacities which are characterized with the symbol positions 30. The opening and closing of the air channel 13 is carried out by rotating the adjusting element 24.

What is claimed is:

1. An engine drive hand-operated tool (100, 200, 300, 400) with at least one handle (10, 11) which is configured hollow, with a driving engine (12), and a fluid cooling means causing a cooling fluid flow (18) for cooling the driving engine (12), wherein said at least one handle (10, 11) has at least one inlet opening (20) and at least one outlet opening (22), the inlet opening (20) and the outlet opening (22) being placed in such a way that downstream of the engine at least a part of the cooling fluid flow (18) for the driving engine (12) flows into the handle (10, 11) by way of the inlet opening (20), flows through the handle (10, 11) over a predetermined section of the handle and flows out of the handle (10, 11) by way of the outlet opening (22).

2. A hand-operated tool according to claim 1, wherein the cooling fluid is air.

3. A hand-operated tool according to claim 2, wherein an air conducting device (16) is fixed on the handle adjacent to the inlet opening (20) and is configured in such a way that at least a portion of the cooling air flow (18) is guided by the air conducting device so as to flow into the inlet opening (20) on the handle (10, 11).

4. A hand-operated tool according to claim 3, wherein the air conducting device (16) is pushed onto the handle (10).

5. A hand-operated tool according to claim 3, wherein the air conducting device (16) is snapped onto the handle (10).

6. A hand-operated tool according to claim 3, wherein the air conducting device (16) is molded onto the handle (10).

7. A hand-operated tool according to claim 1, wherein the cooling fluid is water.

8. A hand-operated tool according to claim 1, wherein at least one adjusting element (24) is provided for selectively opening, partially opening or closing the inlet opening (20).

9. A hand-operated tool according to claim 1, wherein at least one adjusting element (24) is provided for selectively opening, partially opening or closing the outlet opening (22).

10. A hand-operated tool according to claim 1, wherein the handle (10) is a stirrup-shaped handle.

11. A hand-operated tool according to claim 1, wherein the handle (10) is an all round handle.

12. A hand-operated tool according to claim 1, wherein the handle (10) is a metal tube handle.

13. A hand-operated tool according to claim 1, wherein the handle (10) is a plastic tube handle.

14. An engine drive hand-operated tool (100,200,300, 400) with at least one handle (10, 11) which is configured hollow, with a driving engine (12), and a fluid cooling means causing a cooling fluid flow (18) for the driving engine (12), wherein said at least one handle (10, 11) has at least one inlet opening (20) and at least one outlet opening (22), the inlet opening (20) and the outlet opening (22) being placed in such a way that the cooling fluid flow (18) for the driving engine (12) flows into the handle (10, 11) by way of the inlet opening (20), flows through the handle (10, 11) over a predetermined section of the handle and flows out of the handle (10, 11) by way of the outlet opening (22), and wherein the tool has an integrated tank/handle system (32) having the inlet opening (20), and a device (16) is provided for guiding the cooling fluid flow (18) downstream of the driving engine (12) to the inlet opening (20) of the tank/handle system (32).

15. A hand-operated tool according to claim 14, wherein the tank of the tank/handle system (32) is a fuel tank.

16. A hand-operated tool according to claim 14, wherein the tank of the tank/handle system (32) is a lubricant tank.

* * * * *